US010807368B2

(12) United States Patent
Tang

(10) Patent No.: US 10,807,368 B2
(45) Date of Patent: Oct. 20, 2020

(54) CO-PLATFORM PRINTER MECHANISM HAVING MULTIPLE HOSTS

(71) Applicant: GUANGZHOU CRYSTALJET INDUSTRY CO., LTD., Guangdong (CN)

(72) Inventor: Zhenhua Tang, Guangzhou, Guangdong (CN)

(73) Assignee: GUANGZHOU CRYSTALJET INDUSTRY CO., LTD., Guangzhou (CN)

( * ) Notice: Subject to any disclaimer, the term of this patent is extended or adjusted under 35 U.S.C. 154(b) by 0 days.

(21) Appl. No.: 16/529,175

(22) Filed: Aug. 1, 2019

(65) Prior Publication Data

US 2019/0351677 A1 Nov. 21, 2019

Related U.S. Application Data

(63) Continuation of application No. PCT/CN2017/105609, filed on Oct. 11, 2017.

(30) Foreign Application Priority Data

Feb. 8, 2017 (CN) ..... 2017 2 0117063 U

(51) Int. Cl.
*B41J 2/145* (2006.01)

(52) U.S. Cl.
CPC ..... *B41J 2/145* (2013.01); *B41J 2202/19* (2013.01); *B41J 2202/20* (2013.01)

(58) Field of Classification Search
CPC .... B41J 2/145; B41J 2202/19; B41J 2202/20; B41J 29/02; B41J 29/026; B41J 2202/21;
(Continued)

(56) References Cited

U.S. PATENT DOCUMENTS

2009/0122095 A1 5/2009 Won
2009/0128607 A1 5/2009 Schmitt
(Continued)

FOREIGN PATENT DOCUMENTS

CN 101434145 A 5/2009
CN 102099195 A 6/2011
(Continued)

OTHER PUBLICATIONS

IP.com search (Year: 2020).*
(Continued)

*Primary Examiner* — Lisa Solomon
(74) *Attorney, Agent, or Firm* — Pearne & Gordon LLP

(57) ABSTRACT

A printer mechanism having multiple hosts on a common platform, the printer mechanism comprising: a conveying platform (100) used for conveying a printing substrate, and an inkjet system (200) composed of a number of relatively independent hosts (210) connected to each other, the host (210) comprising at least a main cabinet (211) and an upper cabinet (212) extending from a side of the main cabinet (211), and the upper cabinets (212) of the whole inkjet system (200) being distributed in parallel above the conveying platform (100); and the printer mechanism further comprising a spray carriage system (300) composed of a number of relatively independent spray carriages (310) installed with a spray nozzle module and connected to each other, the spray carriage system (300) being disposed between the inkjet system (200) and the conveying platform (100), and the spray carriages (310) being correspondingly connected to the hosts (210) one by one.

8 Claims, 5 Drawing Sheets

(58) Field of Classification Search
CPC ..... B41J 25/3086; B41J 25/308; B41J 3/543; B41J 19/00
See application file for complete search history.

(56) References Cited

U.S. PATENT DOCUMENTS

| | | | | |
|---|---|---|---|---|
| 2011/0128323 | A1 | 6/2011 | Saito | |
| 2013/0057612 | A1* | 3/2013 | Song | B41J 11/001 347/31 |

FOREIGN PATENT DOCUMENTS

| | | | |
|---|---|---|---|
| CN | 103129131 | A1 | 6/2013 |
| CN | 103625111 | A1 | 3/2014 |

OTHER PUBLICATIONS

International Search Report Issued in Patent Application No. PCT/CN2017/105609 dated Jan. 19, 2018.
Written Opinion Issued in Patent Application No. PCT/CN2017/105609 dated Jan. 19, 2018.

* cited by examiner

CO-PLATFORM PRINTER MECHANISM HAVING MULTIPLE HOSTS

CROSS-REFERENCE TO RELATED APPLICATIONS

This is a continuation of International Application No. PCT/CN2017/105609, filed Oct. 11, 2017, which claims priority from Chinese Patent Application No. 201720117063.4, filed on Feb. 8, 2017, the contents of all of which are incorporated herein by reference in their entireties.

TECHNICAL FIELD

The present utility model relates to the field of printers, and more particularly to a printer mechanism having multiple hosts on a common platform.

BACKGROUND ART

According to an industrial printer suitable for a large-size printing medium, such as ceramic or glass, ink of various colors is ejected on a printing medium via a spray nozzle by means of an ink spray method, and the printing medium is then fired to realize printing. The spray nozzle of the printer is provided with multiple mutually staggered tiny holes through which the ink is ejected. One spray nozzle module is typically provided with multiple mutually staggered spray nozzles, and the number of the spray nozzle modules is determined according to the requirement of printing precision. The higher the precision requirement is, the more the spray nozzle modules are required. The number of modules in each model of conventional printers is predetermined, and in actual production, reduction printing can be realized by shielding excess modules according to different printing needs, which requires a user to purchase a printer with multiple modules beyond the actual demand, and thus increases the initial investment of production. If a printer with less modules is used in the initial investment, it is impossible to extend, and once the precision requirement is increased, it is necessary to additionally purchase a multi-module printer, which increases the equipment investment.

In the prior art, in order to provide the user with more purchase solutions, a modular printer is provided, which is composed of multiple inkjet units that are independent from each other and can be freely combined with each other, the user can purchase a printer composed of a suitable number of inkjet units according to actual needs, and when the printer needs to extend, it only needs to additionally purchase inkjet units of the same model and assemble same to the original printer, which provides the user with more purchase options. However, in order to protect the spray nozzles, the spray nozzle modules usually need to be installed last. Since the inkjet units are relatively independent, the spray nozzle modules need to be installed one by one during installation, and the distances between each of the spray nozzles and the printing medium need to be adjusted one by one according to the actual printing requirement during printing, which is not only cumbersome and increases the workload, and is also difficult to ensure the same distance between each of the spray nozzle modules and the printing medium. Therefore, it is necessary to improve the prior art.

Technical Problem

In order to overcome at least one of the deficiencies described above in the prior art, the present utility model provides a printer mechanism having multiple hosts on a common platform, which can be freely assembled and extended, is easy to assemble and is convenient for operation.

Solution to Problem

Technical Solution

In order to solve the above technical problems, the present utility model uses the following technical solutions:

a printer mechanism having multiple hosts on a common platform, the printer mechanism comprising: a conveying platform used for conveying a printing substrate, and an inkjet system composed of a number of relatively independent hosts connected to each other, the host comprising at least a main cabinet and an upper cabinet extending from a side of the main cabinet, and the upper cabinets of the whole inkjet system being distributed in parallel above the conveying platform; and the printer mechanism further comprising a spray carriage system composed of a number of relatively independent spray carriages installed with a spray nozzle module and connected to each other, the spray carriage system being disposed between the inkjet system and the conveying platform, and the spray carriages being correspondingly connected to the hosts one by one.

According to the patent, spray nozzles are separated from the hosts, and all the spray nozzles are combined to form the spray carriage system, achieving the integral installation of the spray nozzles, and the height of all of the spray nozzles can be easily controlled so as to achieve a uniform distance between each of the spray nozzles and the printing substrate, thus saving on time for installation and distance adjustment. Since both the spray carriage system and the inkjet system can be assembled in a modular manner, a user can purchase the same number of spray carriages and hosts according to actual needs, and it only needs to additionally purchase the same model of spray carriages and hosts for extension in the late and connect same to the spray carriages and hosts purchased in the early so as to complete the extension of the printer, so that the user does not need to be entangled in the contradiction between the limited initial investment funds and the later production extension demand. When the precision requirement is reduced, reduction printing can be realized by shielding the excess modules or by removing excess hosts and spray carriages according to different printing needs, thereby realizing free assembly and extension of the printer, reducing the assembly difficulty and saving on the assembly time. At the same time, when a single host fails, the failed host can be replaced to continue printing, avoiding delaying the production schedule due to repair, and replacement or maintenance for the hosts can be carried out one by one during machine maintenance so as to ensure continuous work during the machine maintenance.

The printing substrate of different materials has different requirements on the distance between the spray nozzle and the surface of the printing substrate, and the distance between the spray nozzle and the surface of the printing substrate will also change due to the printing substrates different in thickness, so it is necessary to readjust the height of the spray nozzle every time replacing the printing substrates of different batches, and in order to conveniently adjust the height of the spray nozzle, the spray carriage system is provided with a lifting mechanism for easy adjustment, specifically: the spray carriage system comprises a support base and a number of spray carriages, each of the spray carriages is provided with a lifting frame, a number of installation sites arranged in parallel are disposed at a front face of the support base, the lifting frames are correspondingly installed to the installation sites one by one, each of the installation sites is provided with a screw rod, the screw rod supports the lifting frame, and a transmission mechanism for transmission of a synchronous action is disposed between the screw rods. The driving mechanism, such as an electric motor, drives a screw rod or the transmission mechanism to rotate, and when the screw rod rotates, the other screw rods are driven by the transmission mechanism to synchronously rotate, or the number of screw rods are driven to synchronously rotate when the transmission mechanism rotates, thereby achieving simultaneous height adjustment for the spray nozzles of multiple spray carriages, which is convenient for operation and shortens the production cycle.

Because the spray nozzle is relatively fragile and it determines the printing effect and quality, in order to protect the spray nozzle and avoid damage to the spray nozzle during storage or transportation, the spray nozzle usually needs to be packaged and stored separately and installed in the final step of the assembly. For the installation and disassembly of the spray nozzle, the spray carriage is provided with several trays for installation of the spray nozzle module, the trays are arranged in parallel on the lifting frame, and during installation, the spray nozzles are installed one by one in installation holes of the trays, which is simple for operation and reliable for installation.

Preferably, the transmission mechanism is a transmission link.

In order to improve the stability of the printer mechanism, the conveying platform comprises a conveyor belt, a power mechanism that drives the conveyor belt for transport, and support portions disposed at both ends of the conveyor belt, wherein the support portions support the conveyor belt, and at least a receiving space is formed below the conveyor belt. The conveying platform is relatively independent, and the conveyor belt is independently fixed and supported by the support portions, which will not interfere with addition or reduction or replacement of the hosts. When the production line is assembled, the support portions can be fixedly connected to the ground, so as to determine the position of the conveying platform and avoid affecting the effect and precision of the inkjet due to the displacement of the conveying platform caused by an external force, which ensures the stability of production.

In order to improve the flexibility of addition or reduction or replacement of the hosts, a side opening is formed at a front face or a bottom face of the host, the side opening is located between the upper cabinet and the main cabinet, and part of the conveying platform is suspended in the side opening. The host is of a C-shape or an inverted U-shape viewed from the side, so that certain host can be quickly pulled out or pushed in from a side or both ends of the conveyor belt, and the host will not be in contact with the conveyor belt during the movement, thereby further improving the maintenance efficiency of the equipment. For a host of a C-shape viewed from the side, any one host can be pulled out or pushed in directly from the side of the conveyor belt; and for a host of an inverted U-shape viewed from the side, the upper cabinet can be stably supported and is not prone to warp.

During use, in order to fix the relatively independent hosts to each other, both sides of the host are provided with positioning mechanisms connected to the adjacent hosts, and multiple hosts are connected together by the positioning mechanisms to form an inkjet system so as to avoid affecting the effect and precision of the inkjet due to the relative movement between the hosts caused by an external force.

In order to enable the hosts to work independently without interference with each other, the host is internally installed with an independent ink spray system, a control system, an ink supply system that supplies ink to the ink spray system, and a temperature control system that controls the inkjet temperature of ink from the ink spray system, the ink spray system is disposed in the upper cabinet, and the ink spray systems of the hosts are correspondingly connected to the spray nozzle modules on the spray carriages one by one. Each host can realize inkjet of different colors according to different ink provided by the ink supply system, and the improvement in precision can be achieved by means of staggered inkjet set by the control system.

Beneficial Effects of the Invention

Beneficial Effects

According to the patent, spray nozzles are separated from the hosts, and all the spray nozzles are combined to form the spray carriage system, achieving the integral installation of the spray nozzles, and the height of all of the spray nozzles can be easily controlled so as to achieve a uniform distance between each of the spray nozzles and the printing substrate, thus saving on time for installation and distance adjustment. The spray carriage system is provided with a lifting mechanism for easy adjustment, thereby achieving simultaneous height adjustment for spray nozzles of multiple spray carriages, which is convenient for operation and shortens the production cycle.

BRIEF DESCRIPTION OF THE DRAWINGS

Description of the Drawings

Figure 1:
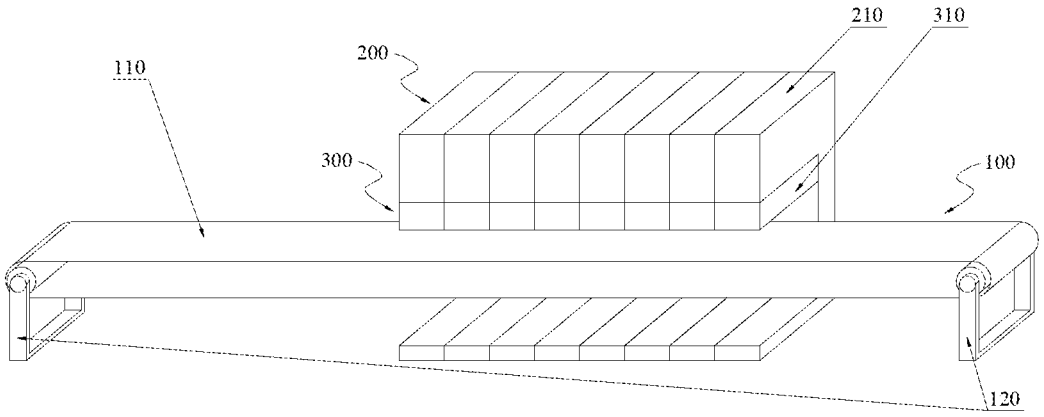
Figure 2:
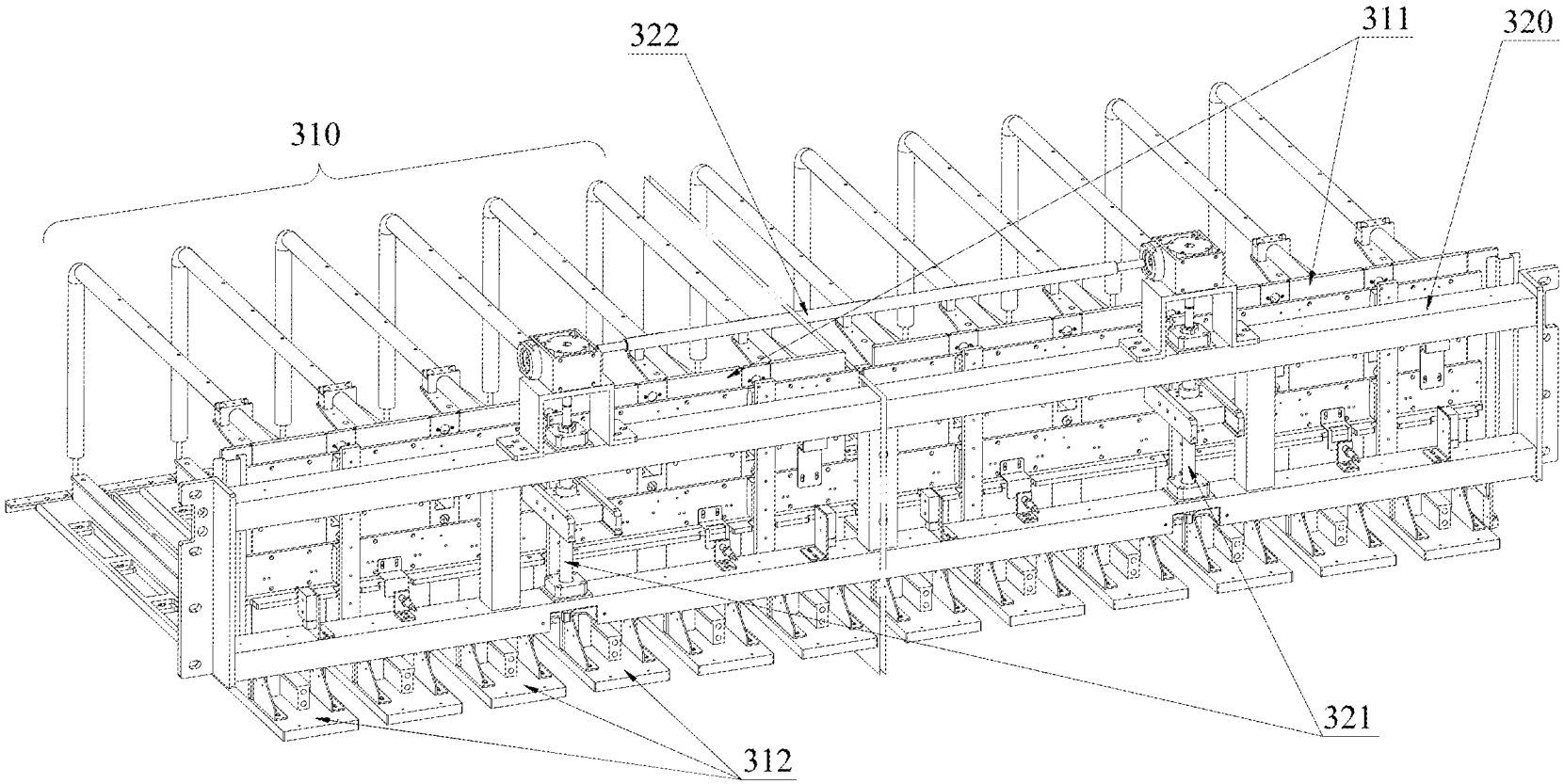
Figure 3:
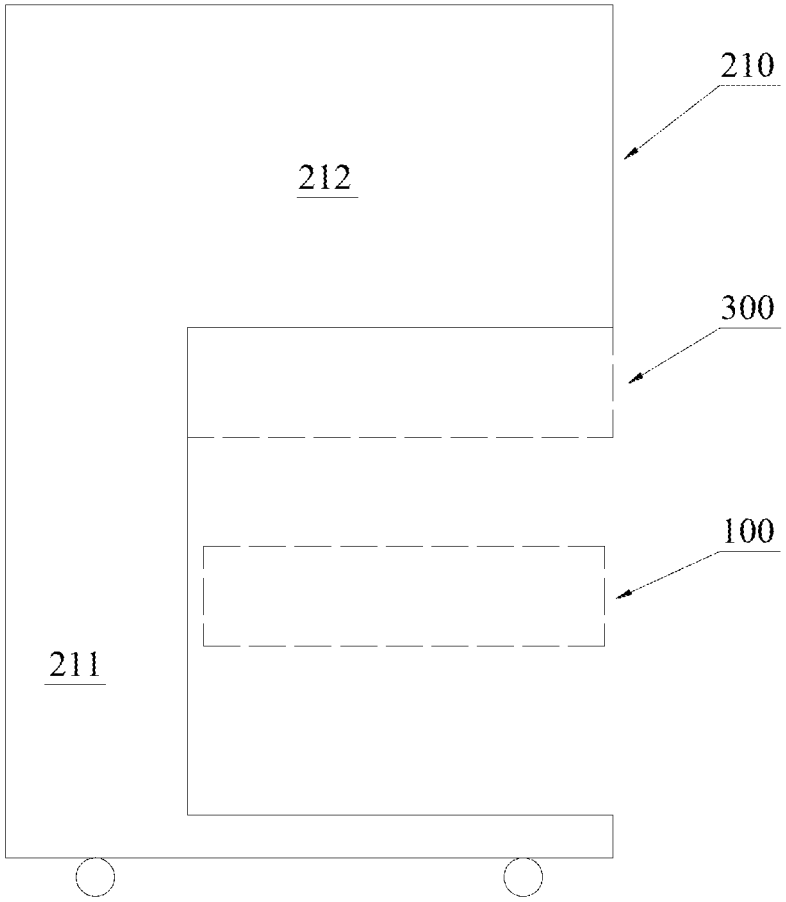
Figure 4:
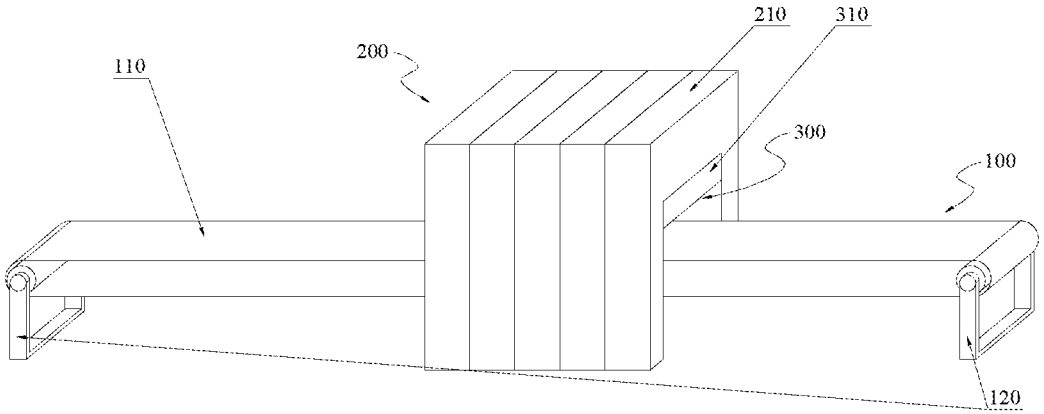
Figure 5:
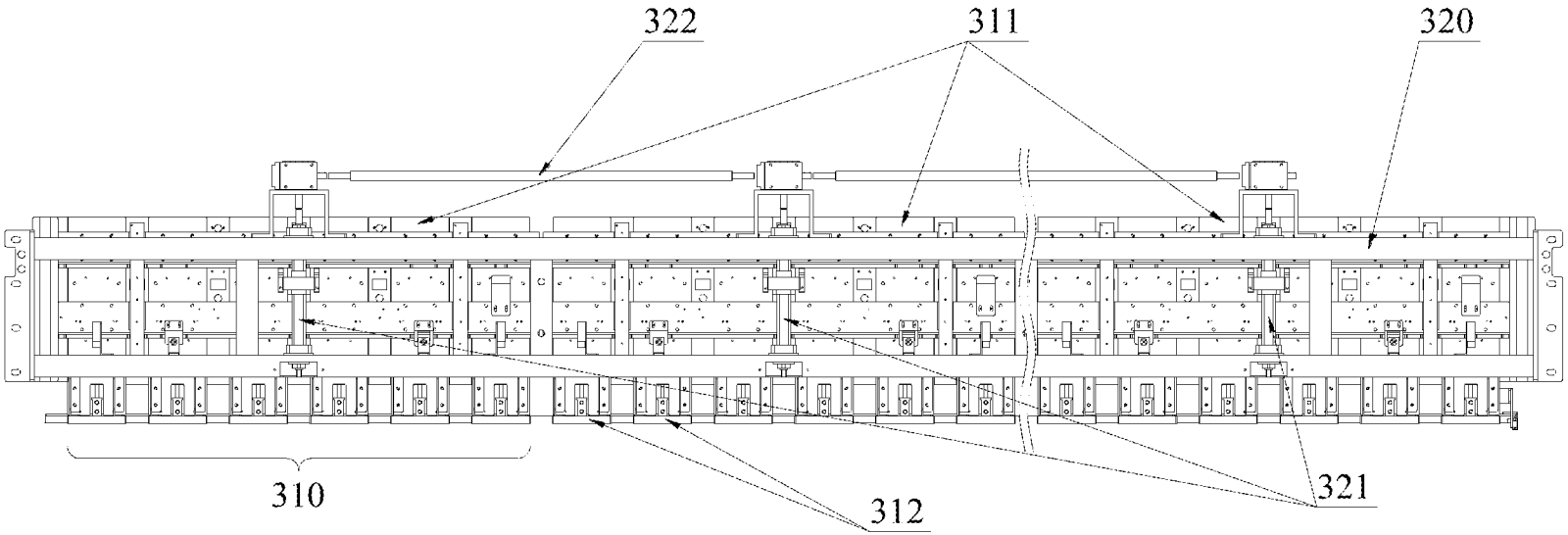
Figure 6:
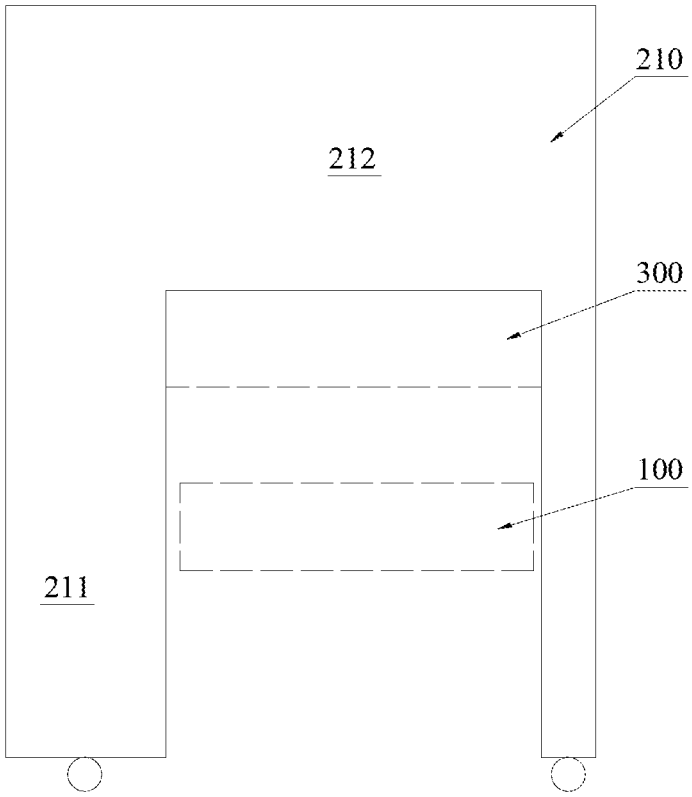

FIG. 1 is a schematic diagram of a printer mechanism having multiple hosts on a common platform of Embodiment 1;

FIG. 2 is a structural schematic diagram of a spray carriage system of Embodiment 1;

FIG. 3 is a structural schematic diagram of a host of Embodiment 1;

FIG. 4 is a schematic diagram of a printer mechanism having multiple hosts on a common platform of Embodiment 2;

FIG. 5 is a structural schematic diagram of a spray carriage system of Embodiment 2;

FIG. 6 is a structural schematic diagram of a host of Embodiment 2;

Description of Reference Signs: conveying platform 100, conveyor belt 110, support portion 120, inkjet system 200, host 210, main cabinet 211, upper cabinet 212, spray carriage system 300, spray carriage 310, lifting frame 311, support base 320, screw rod 321, transmission link 322.

EMBODIMENTS OF THE INVENTION

Particular Embodiments of the Invention

The drawings are used for exemplary illustration only and are not to be construed as limiting this patent. In order to better illustrate the embodiment, some components in the drawings may be omitted, enlarged or reduced, which does not represent the actual product size. Those skilled in the art will understand that some well-known structures and illustration therefor may be omitted in the drawings. The terms for describing positional relationship in the drawings are for exemplary illustration only and are not to be construed as limiting this patent. The present utility model will be further illustrated in detail below in conjunction with particular embodiments.

Embodiment 1

As shown in FIG. 1, a printer mechanism having multiple hosts on a common platform comprises a conveying platform 100 for conveying a printing substrate, an inkjet system 200 composed of eight relatively independent hosts 210 connected to each other, and a spray carriage system 300 composed of eight relatively independent spray carriages 310 installed with a spray nozzle module and connected to each other, the host 210 comprising at least a main cabinet 211 and an upper cabinet 212 extending from a side of the main cabinet 211, the upper cabinets 212 of the whole inkjet system 200 being distributed in parallel above the conveying platform 100, the spray carriage system 300 being disposed between the inkjet system 200 and the conveying platform 100, and the spray carriages 310 being correspondingly connected to the hosts 210 one by one.

According to this embodiment, spray nozzles are separated from the hosts 210, and all the spray nozzles are combined to form the spray carriage system 300, achieving the integral installation of the spray nozzles, and the height of all of the spray nozzles can be easily controlled so as to achieve a uniform distance between each of the spray nozzles and the printing substrate, thus saving on time for installation and distance adjustment. Since both the spray carriage system 300 and the inkjet system 200 can be assembled in a modular manner, a user can purchase the same number of spray carriages 310 and hosts 210 according to actual needs, and it only needs to additionally purchase the same model of spray carriages 310 and hosts 210 for extension in the late and connect same to the spray carriages 310 and hosts 210 purchased in the early so as to complete the extension of the printer, so that the user does not need to be entangled in the contradiction between the limited initial investment funds and the later production extension demand. When the precision requirement is reduced, reduction printing can be realized by shielding the excess modules or by removing excess hosts 210 and spray carriages 310 according to different printing needs, thereby realizing free assembly and extension of the printer, reducing the assembly difficulty and saving on the assembly time. At the same time, when a single host 210 fails, the failed host 210 can be replaced to continue printing, avoiding delaying the production schedule due to repair, and replacement or maintenance for the hosts can be carried out one by one during machine maintenance so as to ensure continuous work during the machine maintenance.

The printing substrate of different materials has different requirements on the distance between the spray nozzle and the surface of the printing substrate, and the distance between the spray nozzle and the surface of the printing substrate will also change due to the printing substrates different in thickness, so it is necessary to readjust the height of the spray nozzle every time replacing the printing substrates of different batches, and in order to conveniently adjust the height of the spray nozzle, the spray carriage system 300 is provided with a lifting mechanism for easy adjustment, specifically: as shown in FIG. 2, the spray carriage system 300 comprises a support base 320 and eight spray carriages 310, the spray carriage 310 is provided with a lifting frame 311, eight installation sites arranged in parallel are disposed at a front face of the support base 320, the lifting frames 311 are correspondingly installed to the installation sites one by one, each of the installation sites is provided with a screw rod 321, the screw rod 321 supports the lifting frame 311, and a transmission link 322 for transmission of a synchronous action is disposed between the screw rods 321. The driving mechanism, such as an electric motor, drives a screw rod 321 or the transmission mechanism to rotate, and when the screw rod 321 rotates, the other screw rods 321 are driven by the transmission link 322 to synchronously rotate, or the eight screw rods 321 are driven to synchronously rotate when the transmission link 322 rotates, thereby achieving simultaneous height adjustment for the spray nozzles of multiple spray carriages 310, which is convenient for operation and shortens the production cycle.

Because the spray nozzle is relatively fragile and it determines the printing effect and quality, in order to protect the spray nozzle and avoid damage to the spray nozzle during storage or transportation, the spray nozzle usually needs to be packaged and stored separately and installed in the final step of the assembly. For the installation and disassembly of the spray nozzle, the spray carriage 310 is provided with several trays 312 for installation of the spray nozzle module, the trays are arranged in parallel on the lifting frame 311, and during installation, the spray nozzles are installed one by one in the installation holes of the trays, which is simple for operation and reliable for installation.

In order to improve the stability of the printer mechanism, the conveying platform 100 comprises a conveyor belt 110, a power mechanism that drives the conveyor belt 110 for transport, and support portions 120 disposed at both ends of the conveyor belt 110, the support portions 120 support the conveyor belt 110, and at least a receiving space is formed below the conveyor belt 110. The conveying platform 100 is relatively independent, and the conveyor belt 110 is independently fixed and supported by the support portions 120, which will not interfere with addition or reduction or replacement of the hosts 210. When the production line is assembled, the support portions can be fixedly connected to the ground, so as to determine the position of the conveying platform 100 and avoid affecting the effect and precision of the inkjet due to the displacement of the conveying platform 100 caused by an external force, which ensures the stability of production.

As shown in FIG. 3, in order to improve the flexibility of addition or reduction or replacement of the hosts 210, a side opening is formed at a front face of the hosts 210, the side opening is located between the upper cabinet 212 and the main cabinet 211, and part of the conveying platform 100 is suspended in the side opening. Viewed from the side, the host 210 is of a C-shape, so that any one host 210 can be quickly pull out of or push in from a side of the conveyor belt 110, and the host 210 will not be in contact with the conveyor belt 110 during the movement, thereby further improving the maintenance efficiency of the equipment.

During use, in order to fix the relatively independent hosts 210 to each other, both sides of the hosts 210 are provided with positioning mechanisms connected to the adjacent hosts 210, and multiple hosts 210 are connected together by the positioning mechanisms to form an inkjet system 200 so as to avoid affecting the effect and precision of the inkjet due to the relative movement between the hosts 210 caused by an external force.

In order to enable the hosts 210 to work independently without interference with each other, the host 210 is internally installed with an independent ink spray system, a control system, an ink supply system that supplies ink to the ink spray system, and a temperature control system that controls the inkjet temperature of ink from the ink spray system, the ink spray system is disposed in the upper cabinet 212, and the ink spray systems of the hosts 210 are correspondingly connected to the spray nozzle modules on the spray carriages 310 one by one. Each host 210 can realize inkjet of different colors according to different ink provided by the ink supply system, and the improvement in precision can be achieved by means of staggered inkjet set by the control system.

Embodiment 2

As shown in FIGS. 4-5, a printer mechanism having multiple hosts on a common platform comprises a conveying platform 100 for conveying a printing substrate, an inkjet system 200 composed of five relatively independent hosts 210 connected to each other, and a spray carriage system 300 composed of five relatively independent spray carriages 310 installed with a spray nozzle module and connected to each other, the host 210 comprising at least a main cabinet 211 and an upper cabinet 212 extending from a side of the main cabinet 211, the upper cabinets 212 of the whole inkjet system 200 being distributed in parallel above the conveying platform 100, the spray carriage system 300 being disposed between the inkjet system 200 and the conveying platform 100, and the spray carriages 310 being correspondingly connected to the hosts 210 one by one.

According to this embodiment, spray nozzles are separated from the hosts 210, and all the spray nozzles are combined to form the spray carriage system 300, achieving the integral installation of the spray nozzles, and the height of all of the spray nozzles can be easily controlled so as to achieve a uniform distance between each of the spray nozzles and the printing substrate, thus saving on time for installation and distance adjustment. Since both the spray carriage system 300 and the inkjet system 200 can be assembled in a modular manner, a user can purchase the same number of spray carriages 310 and hosts 210 according to actual needs, and it only needs to additionally purchase the same model of spray carriages 310 and hosts 210 for extension in the late and connect same to the spray carriages 310 and hosts 210 purchased in the early so as to complete the extension of the printer, so that the user does not need to be entangled in the contradiction between the limited initial investment funds and the later production extension demand. When the precision requirement is reduced, reduction printing can be realized by shielding the excess modules or by removing excess hosts 210 and spray carriages 310 according to different printing needs, thereby realizing free assembly and extension of the printer, reducing the assembly difficulty and saving on the assembly time. At the same time, when a single host 210 fails, the failed host 210 can be replaced to continue printing, avoiding delaying the production schedule due to repair, and replacement or maintenance for the hosts can be carried out one by one during machine maintenance so as to ensure continuous work during the machine maintenance.

The printing substrate of different materials has different requirements on the distance between the spray nozzle and the surface of the printing substrate, and the distance between the spray nozzle and the surface of the printing substrate will also change due to the printing substrates different in thickness, so it is necessary to readjust the height of the spray nozzle every time replacing the printing substrates of different batches, and in order to conveniently adjust the height of the spray nozzle, the spray carriage system 300 is provided with a lifting mechanism for easy adjustment, specifically: as shown in FIG. 2, the spray carriage system 300 comprises a support base 320 and five spray carriages 310, the spray carriage 310 is provided with a lifting frame 311, five installation sites arranged in parallel are disposed at a front face of the support base 320, the lifting frames 311 are correspondingly installed to the installation sites one by one, each of the installation sites is provided with a screw rod 321, the screw rod 321 supports the lifting frame 311, and a transmission link 322 for transmission of a synchronous action is disposed between the screw rods 321. The driving mechanism, such as an electric motor, drives a screw rod 321 or the transmission mechanism to rotate, and when the screw rod 321 rotates, the other screw rods 321 are driven by the transmission link 322 to synchronously rotate, or the five screw rods 321 are driven to synchronously rotate when the transmission link 322 rotates, thereby achieving simultaneous height adjustment for the spray nozzles of multiple spray carriages 310, which is convenient for operation and shortens the production cycle.

Because the spray nozzle is relatively fragile and it determines the printing effect and quality, in order to protect the spray nozzle and avoid damage to the spray nozzle during storage or transportation, the spray nozzle usually needs to be packaged and stored separately and installed in the final step of the assembly. For the installation and disassembly of the spray nozzle, the spray carriage 310 is provided with several trays 312 for installation of the spray nozzle module, the trays are arranged in parallel on the lifting frame 311, and during installation, the spray nozzles are installed one by one in the installation holes of the trays, which is simple for operation and reliable for installation.

In order to improve the stability of the printer mechanism, the conveying platform 100 comprises a conveyor belt 110, a power mechanism that drives the conveyor belt 110 for transport, and support portions 120 disposed at both ends of the conveyor belt 110, the support portions 120 support the conveyor belt 110, and at least a receiving space is formed below the conveyor belt 110. The conveying platform 100 is relatively independent, and the conveyor belt 110 is independently fixed and supported by the support portions 120, which will not interfere with addition or reduction or replacement of the hosts 210. When the production line is assembled, the support portions can be fixedly connected to the ground, so as to determine the position of the conveying platform 100 and avoid affecting the effect and precision of the inkjet due to the displacement of the conveying platform 100 caused by an external force, which ensures the stability of production.

As shown in FIG. 6, in order to improve the flexibility of addition or reduction or replacement of the hosts 210, a side opening is formed at a bottom face of the host 210, and the side opening is located between the upper cabinet 212 and the main cabinet 211, and part of the transport platform 100 is suspended in the side opening. Viewed from the side, the host is of an inverted U-shape, so that certain host 210 can be quickly pull out of or push in from both ends of the conveyor belt, and the hosts 210 will not be in contact with the conveyor belt 110 during the movement, thereby further improving the maintenance efficiency of the equipment, and the upper cabinet 212 can be stably supported and is not prone to warp.

During use, in order to fix the relatively independent hosts 210 to each other, both sides of the hosts 210 are provided with positioning mechanisms connected to the adjacent hosts 210, and multiple hosts 210 are connected together by the positioning mechanisms to form an inkjet system 200 so as to avoid affecting the effect and precision of the inkjet due to the relative movement between the hosts 210 caused by an external force.

In order to enable the hosts 210 to work independently without interference with each other, the host 210 is internally installed with an independent ink spray system, a control system, an ink supply system that supplies ink to the ink spray system, and a temperature control system that controls the inkjet temperature of ink from the ink spray system, the ink spray system is disposed in the upper cabinet 212, and the ink spray systems of the hosts 210 are correspondingly connected to the spray nozzle modules on the spray carriages 310 one by one. Each host 210 can realize inkjet of different colors according to different ink provided by the ink supply system, and the improvement in precision can be achieved by means of staggered inkjet set by the control system.

Obviously, the above embodiments of the present utility model are merely examples used to clearly illustrate the present utility model, instead of limiting the implementation of the present utility model. For those skilled in the pertinent art, other forms of changes or variations may also be made on the basis of the above illustration. There is no need and no way to exhaustively include all the implementations here. Any modifications, equivalent substitutions, improvements etc. made within the spirit and principles of the present utility model are intended to be included within the scope of protection of the present utility model.

The invention claimed is:

1. A printer mechanism having multiple hosts on a common platform, the printer mechanism comprising: a conveying platform used for conveying a printing substrate, and an inkjet system composed of a number of relatively independent hosts connected to each other, the host comprising at least a main cabinet and an upper cabinet extending from a side of the main cabinet, and the upper cabinets of the whole inkjet system being distributed in parallel above the conveying platform, characterized in that the printer mechanism further comprises a spray carriage system composed of a number of relatively independent spray carriages installed with a spray nozzle module and connected to each other, the spray carriage system being disposed between the inkjet system and the conveying platform, and the spray carriages being correspondingly connected to the hosts one by one.

2. The printer mechanism having multiple hosts on a common platform according to claim 1, characterized in that the spray carriage system comprises a support base and a number of spray carriages, each of the spray carriages is provided with a lifting frame, a number of installation sites arranged in parallel are disposed at a front face of the support base, the lifting frames are correspondingly installed to the installation sites one by one, each of the installation sites is provided with a screw rod, the screw rod supports the lifting frame, and a transmission mechanism for transmission of a synchronous action is disposed between the screw rods.

3. The printer mechanism having multiple hosts on a common platform according to claim 2, characterized in that the spray carriage is provided with a number of trays for installing the spray nozzle module, and the trays are arranged in parallel on the lifting frame.

4. The printer mechanism having multiple hosts on a common platform according to claim 2, characterized in that the transmission mechanism is a transmission link.

5. The printer mechanism having multiple hosts on a common platform according to claim 1, characterized in that the conveying platform comprises a conveyor belt, a power mechanism that drives the conveyor belt for transport, and support portions disposed at both ends of the conveyor belt, wherein the support portions support the conveyor belt, and at least a receiving space is formed below the conveyor belt.

6. The printer mechanism having multiple hosts on a common platform according to claim 1, characterized in that a side opening is formed at a front face or a bottom face of the host, the side opening is located between the upper cabinet and the main cabinet, part of the conveying platform is suspended in the side opening, and the host is of a C-shape or an inverted U-shape viewed from the side.

7. The printer mechanism having multiple hosts on a common platform according to claim 1, characterized in that both sides of the host are provided with a positioning mechanism connected to an adjacent host.

8. The printer mechanism having multiple hosts on a common platform according to claim 1, characterized in that the host is internally installed with an independent ink spray system, a control system, an ink supply system that supplies ink to the ink spray system, and a temperature control system that controls the inkjet temperature of ink from the ink spray system, wherein the ink spray system is disposed in the upper cabinet, and the ink spray systems of the hosts are correspondingly connected to the spray nozzle modules on the spray carriages one by one.

* * * * *